US005629494A

United States Patent [19]

Barnes et al.

[11] Patent Number: 5,629,494

[45] Date of Patent: May 13, 1997

[54] HYDROGEN-LESS, NON-AZIDE GAS GENERANTS

[75] Inventors: Michael W. Barnes, Brigham City; Robert D. Taylor, Hyrum, both of Utah

[73] Assignee: Morton International, Inc., Chicago, Ill.

[21] Appl. No.: 609,270

[22] Filed: Feb. 29, 1996

[51] Int. Cl.[6] ..... C06B 47/08

[52] U.S. Cl. ..... 149/36; 149/109.2

[58] Field of Search ..... 149/109.2, 119, 149/36

[56] References Cited

U.S. PATENT DOCUMENTS

| | | | |
|---|---|---|---|
| 3,468,730 | 9/1969 | Gawlick et al. | 149/61 |
| 3,912,561 | 10/1975 | Doin | 149/35 |
| 4,369,079 | 1/1983 | Shaw | 149/2 |
| 4,370,181 | 1/1983 | Lundstrom | 149/2 |
| 4,909,549 | 3/1990 | Poole et al. | 149/2 |
| 5,035,757 | 7/1991 | Poole | 149/46 |
| 5,139,588 | 8/1992 | Poole | 149/61 |
| 5,197,758 | 3/1993 | Lund et al. | 149/61 |
| 5,460,668 | 10/1995 | Lyon | 149/36 |
| 5,472,535 | 12/1995 | Mendenhall et al. | 149/36 |
| 5,472,647 | 12/1995 | Blau et al. | 264/3.1 |
| 5,500,059 | 3/1996 | Lund et al. | 149/19.1 |
| 5,501,823 | 3/1996 | Lund et al. | 264/3.1 |
| 5,514,230 | 5/1996 | Khandhadia | 149/36 |
| 5,516,377 | 5/1996 | Highsmith et al. | 149/18 |

*Primary Examiner*—Charles T. Jordan
*Assistant Examiner*—John R. Hardee
*Attorney, Agent, or Firm*—Wayne E. Nacker; Gerald K. White

[57] ABSTRACT

A gas generant composition contains no hydrogen, using as the major fuel component cupric and/or zinc bitetrazole and as a major oxidizer component CuO and/or $Fe_2O_3$. A minor fuel component may be a salt of dicyanamide which reduces processing sensitivity of the composition. A minor oxidizer component may be a nitrate, chlorate, or perchlorate salt.

6 Claims, No Drawings

HYDROGEN-LESS, NON-AZIDE GAS GENERANTS

While the major portion of gas generants in use today for inflating automotive airbags are based on azides, particularly sodium azide, there has been a movement away from azide-based compositions due toxicity problems of sodium azide which poses a problem for eventual disposal of un-deployed units. Non-azide formulations are described, for example, in U.S. Pat. Nos. 5,197,758; 3,468,730; 4,909,549; 5,035,757, 3,912,561; 4,369,079 and the teachings of each of which are incorporated herein by reference.

However, non-azide formulations often have their own problems, tending to produce undesirable gases (as opposed to azide which produces only nitrogen upon combustion) and/or high levels of particulates and/or extremely high combustion temperatures (the latter particularly problematic when utilizing aluminum inflator housing or other aluminum parts). While numerous non-azide pyrotechnic compositions have been suggested for inflating passive automotive restraint systems, the majority of these compositions contain hydrogen. One undesirable combustion gas is ammonia, which tends to be produced by hydrogen-containing compositions formulated to burn at moderate temperatures. To reduce the level of ammonia produced, it is known to increase the oxidizer-to-fuel ratio; but this tends to raise the level of nitrogen monooxide and/or nitrogen dioxide to unacceptably high levels, necessitating a balancing act which cannot easily be performed with consistency.

One way to avoid the ammonia/$NO_x$ balancing act is to formulate without hydrogen and to burn at moderate temperatures. Above-referenced U.S. Pat. Nos. 4,369,079 and 4,370,181 are based upon the use of alkali or alkaline earth metal salts of bitetrazoles as fuels. Unfortunately, the compositions of these patents tend to produce solid particulates which are difficult to filter. Particulates may be harmful to vehicle occupants, particularly asthmatics. Also, particulates released to the vehicle interior during airbag deployment give the appearance of smoke and the specter of fire.

SUMMARY OF THE INVENTION

In accordance with the present invention, there is provided a non-azide gas generant in which neither the fuel nor oxygen contains hydrogen, which burns at relatively moderate temperatures, and which produces an easily filterable slag. The gas generant composition comprises between about 20 and about 40 wt % of A), a fuel and between about 60 and about 80 wt % of B) an oxidizer, said weight percentages of A) and B) being based on the total weight of A) plus B). Between about 60 and 100 wt % of the fuel A) comprises a fuel i) selected from the group consisting of cupric bitetrazole, zinc bitetrazole and mixtures thereof; and up to about 40 wt % of the fuel A), preferably at least about 15 wt % of the fuel A) comprises a fuel ii) selected from the group consisting of an alkali metal salts of dicyanamide, an alkaline earth metal salt of dicyanamide, a transition metal salt of dicyanamide and mixtures thereof. Between about 70 and 100 wt % of the oxidizer B) comprises an oxidizer iii) selected from the group consisting of CuO, $Fe_2O_3$, and mixtures thereof, and up to about 30 wt % of the oxidizer, preferably at least 10 wt % of the oxidizer, selected from the group iv) consisting of alkali and alkaline metal salts of nitrate, chlorate, perchlorate and mixtures thereof.

Detailed Description of Certain Preferred Embodiments

The primary fuel component i) is cupric bitetrazole, zinc bitetrazole or a mixture thereof. These fuels provide a high burn rate and, upon combustion, produce easily filterable copper metal and/or ZnO, respectively. Thus, these transition metal salts of bitetrazole are advantageous over alkali and alkaline earth metal salts of bitetrazole which produce particulates that are not easily filtered, and which, upon combustion and inflation of an airbag, fill a passenger compartment with particulates. Cupric bitetrazole is the preferred fuel component i). Neither cupric nor zinc bitetrazole contain hydrogen which can result in the formation of ammonia. Consequently, the compositions of the present invention can be formulated with an appropriate fuel-to-oxidizer ratio so as to minimize the production of $NO_x$, particularly NO and $NO_2$, so as to provide an acceptably low level of these gases in the combustion gases.

While fuel component i) may be used alone, i.e., used at 100% of the fuel A); cupric and zinc, particularly cupric, bitetrazole are very friction-sensitive. Accordingly, it is preferred to utilize a second fuel component ii), which like component i) does not contain hydrogen, and to this end, the dicyanamide salt is utilized. Preferred cations for the dicyanamide salt are cupric, zinc, and sodium, cupric and zinc being preferred over sodium, and cupric being the most preferred. At levels as low as 5 wt % of the fuel A), fuel component ii) reduces the friction-sensitivity of component i). Preferably, component ii) is used at at least about 15 wt % of the fuel A).

The major oxidizer component iii), like the fuel component(s) i) and ii) is selected for producing an easily filterable slag. Cupric oxide (CuO) is the preferred major oxidizer component iii), producing easily filterable copper metal upon combustion.

While oxidizer component iii) may be used as the sole oxidizer, i.e., at 100 wt % of the oxidizer B), the secondary oxidizer iv) is used to improve low temperature ignition and increase gas output level. If used, oxidizer component iv) is generally used at a level of at least about 5 wt % of the oxidizer B), preferably at least about 10 wt %. It is preferred that oxidizer component iv) not be used at a high level so as to minimize its impact on filterability of the combustion products. Preferred secondary oxidizers are nitrates, particularly strontium, sodium and potassium.

To minimize production of $NO_x$, the stoichiometric oxidizer to fuel ratio is between about 1.0 and about 1.3, preferably between about 1.05 and about 1.15. Herein, an oxidizer to fuel ratio of 1.0 is defined as being precisely enough oxidizer to oxidize the fuel to carbon dioxide, nitrogen, water and the appropriate metal or metal oxide. Thus in a formulation where the oxidizer to fuel ratio is 1.05, there is a 5 molar percent excess of oxidizer, and so forth.

While the compositions of the present invention have a number of advantages, including low levels of toxic combustion gases, relatively low burn temperatures which are consistent with use in inflators having aluminum housings and/or other aluminum components, and produce readily filterable slag; the compositions do utilize sensitive fuel components. As noted above, the major fuel component i) has high friction-sensitivity, and the dicynamide salts, particularly cupric dicyanamide, tend to be very sensitive to electrostatic initiation. The sensitivity problems, however, can be adequately addressed by appropriate processing of the generant compositions, particularly by aqueous processing. The generants are preferably manufactured by wet mix/granulation or by mix/spray drying followed by pressing, e.g., into cylindrical pellets. The size and shape of prills or tablets is determined by the ballistic response needed in an inflator design. A typical cylindrical pellet is 0.25 in. diameter, 0.08 in. long.

Gas generant compositions in accordance with the invention may be formulated with only the fuel A) and oxidizer B). However, in addition to the fuel A) and oxidizer B), minor components, such as coolants, pressing aids, , as are known in the art may also be added, typically at levels no greater than about 5 wt % relative to the total of fuel A) plus oxidizer B). Like the fuel A) components i) and ii) and oxidizer B) components iii) and iv), any additional minor components used should contain no hydrogen.

The invention will now be described in greater detail by way of specific examples.

Examples 1–4

The following compositions were formulated in accordance with the invention. Percentages are by weight of total composition, percentages of fuel or oxidizer in parenthesis.

| Component | Example 1 | Example 2 | Example 3 | Example 4 |
|---|---|---|---|---|
| Cupric bitetrazole | 21.87 (68.6) | 18.37 (63.6) | 20.88 (66.4) | 45.14 (100) |
| Sodium dicyanamide | | 10.50 (36.4) | 10.56 (33.6) | — |
| Cupric dicyanamide | 10.0 (15.1) | | | |
| Cupric oxide | 56.13 (84.9) | 60.63 (85.2) | 58.00 (84.6) | 44.86 (81.8) |
| Strontium nitrate | 10.00 (15.1) | 10.50 (14.8) | 10.56 (15.4) | 10.00 (18.2) |

Compositions 1 was prepared by preparing a slurry of cupric bitetrazole in water by the reaction of cupric oxide with bitetrazole dihydrate according to the equation:

$$CuO+C_2H_2N_8\cdot 2H_2O \rightarrow CuC_2N_8+3H_2O,$$

and a slurry of cupric dicyanamide in water by the reaction of cupric nitrate with sodium dicyanamide according to the equation:

$$Cu(NO_3)_2\cdot .2.5H_2O+2NaN(CN)_2 \rightarrow Cu(N(CN)_2)_2+2NaNO_3+2.5H_2O.$$

The 2 slurries were combined and additional material was added as required for the formulation. Mixing was completed using a high shear mixer. The mixture was dried until it could be pressed through a 6 mesh screen and then drying was completed.

More specifically, bitetrazole dihydrate (4.32 gm) was dissolved in 8.3 ml. of water by heating to approximately 80° C. Cupric oxide (14.9 gm) was added, the mixture was hand-stirred, and then the mixture was heated on a water bath at 80° C. for approximately one hour with occasional stirring by hand. Sodium dicyanamide (2.5 gm.) was dissolved in 8.3 ml. of water. Cupric nitrate (3.27 gm) was added slowly portion-wise with stirring to produce a blue precipitate of cupric dicyanamide. It was heated on the water bath at 80° C. for approximately one hour. The two slurries were combined and mixed on a Proline® model 400B laboratory homogenizer for approximately 5 min. The slurry was dried in a vacuum oven for approximately 3 hours at 85° C. and granulated by pressing through a 6 mesh screen and drying was completed in the vacuum oven for an additional two hours.

The composition had a burn rate of 0.8 inches per second as measured by burning a pressed slug of material in a closed bomb at 100 psi. The friction sensitivity of the formulation as measured on BAM friction test apparatus was 120 newtons. Other safety tests results were acceptable according to internally set standards.

The table below gives the measured/calculated results for hydrogen-less gas generants in accordance with the invention. Results show that it is preferred to utilize a dicynamide salt as a co-fuel with the bitetrazole salt (Examples 2 and 3) to mitigate friction sensitivity.

| Composition | Example 2 | Example 3 | Example 4 |
|---|---|---|---|
| Friction sensitively (Newtons) | 160 | 120 | 20 |
| Burn rate (inches/sec. (ips)) | 0.8 | 0.83 | |
| Theoretical gas yield (moles 100 gm) | 1.14 | 1.02 | |
| Theoretical combustion temp. (°Kelvin) | 1550 | 1517 | |

What is claimed is:

1. A hydrogen-less gas generant composition consisting essentially of

A) between about 20 and about 40 wt % of a fuel and B) between about 60 and about 80 wt % of B) an oxidizer, said weight percentages of A) and B) being calculated on the total weight of A) plus B), between about 60 and 95 wt % of said fuel A) comprising a fuel component i) selected from the group consisting of cupric bitetrazole, zinc bitetrazole and mixtures thereof, and between about 5 wt % and about 40 wt % of said fuel A) comprising a fuel component ii) selected from the group consisting of cupric dicyanamide, zinc dicyanamide and mixtures thereof, between about 70 and 100 wt % of said oxidizer B) comprising an oxidizer component iii) selected from the group consisting of CuO, $Fe_2O_3$, and mixtures thereof, and up to about 30 wt % of said oxidizer B) comprising an oxidizer component iv) selected from the group consisting of alkali and alkaline metal salts of nitrate, chlorate, perchlorate, and mixtures thereof.

2. A gas generant composition in accordance with claim 1 wherein said fuel component i) is cupric bitetrazole.

3. A gas generant composition in accordance with claim 1 wherein said fuel component ii) is zinc bitetrazole.

4. A gas generant composition in accordance with claim 1 wherein said oxidizer component iii) is cupric oxide.

5. A gas generant composition in accordance with claim 1 wherein fuel component ii) is cupric dicyanamide.

6. A gas generant composition in accordance with claim 1 wherein fuel component ii) is zinc dicyanamide.

* * * * *